US010087600B2

(12) United States Patent
Hoyt et al.

(10) Patent No.: US 10,087,600 B2
(45) Date of Patent: Oct. 2, 2018

(54) PITCH ADJUSTMENT ASSEMBLY FOR MACHINE-MOUNTED TOOL

(71) Applicant: Caterpillar Inc., Peoria, IL (US)

(72) Inventors: Daniel Wilson Hoyt, Brimfield, IL (US); Benjamin Thomas Nelson, Dunlap, IL (US); Colin Swan Garnett, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 278 days.

(21) Appl. No.: 15/066,984

(22) Filed: Mar. 10, 2016

(65) Prior Publication Data

US 2017/0260715 A1 Sep. 14, 2017

(51) Int. Cl.

| | |
|---|---|
| ***E02F 3/76*** | (2006.01) |
| *E02F 3/815* | (2006.01) |
| *E02F 3/84* | (2006.01) |

(52) U.S. Cl.

CPC ..... *E02F 3/7618* (2013.01); *E02F 3/7609* (2013.01); *E02F 3/7613* (2013.01); *E02F 3/815* (2013.01); *E02F 3/844* (2013.01)

(58) Field of Classification Search

CPC ..... E02F 3/815; E02F 3/8152; E02F 3/7618; E02F 3/7613; E02F 3/844; E02F 3/7609; B60G 7/02; B60G 3/04; B62D 17/00

USPC ..... 172/701.1, 818, 821–826

See application file for complete search history.

(56) References Cited

U.S. PATENT DOCUMENTS

| | | | | |
|---|---|---|---|---|
| 1,765,122 | A | 12/1930 | Hughes | |
| 5,069,296 | A * | 12/1991 | Horsch | E02F 3/7618 172/825 |
| 5,104,141 | A * | 4/1992 | Grove | B60G 13/006 280/86.753 |
| 5,333,697 | A | 8/1994 | Frisbee et al. | |
| 5,853,051 | A | 12/1998 | Buchanan et al. | |
| 5,924,496 | A * | 7/1999 | Buchanan | E02F 3/7618 172/818 |
| 6,684,961 | B2 * | 2/2004 | Ruckle | A01B 61/046 172/265 |
| 6,863,461 | B2 * | 3/2005 | Werner | E02F 3/7618 403/43 |
| 8,166,451 | B2 | 5/2012 | Ditzler | |
| 9,186,945 | B2 * | 11/2015 | Luttinen | B60G 3/06 |
| 9,689,142 | B2 * | 6/2017 | Bradley | E02F 3/7618 |

FOREIGN PATENT DOCUMENTS

| | | |
|---|---|---|
| EP | 0 849 406 | 6/2002 |

* cited by examiner

*Primary Examiner* — Robert E Pezzuto

(74) *Attorney, Agent, or Firm* — Finnegan, Henderson, Farabow, Garrett & Dunner, LLP

(57) ABSTRACT

An assembly for use in adjusting a pitch of a tool relative to a machine may have a link with a first end connectable to the tool and a second end connectable to the machine. The assembly may also have a bushing configured to engage a slot in at least one of the machine and the tool. An offset bore may be formed in the bushing. The assembly may also have a pin passing through the offset bore of the bushing and the link. The bushing may be reconfigurable between a plurality of discrete positions within the slot to incrementally adjust the pitch of the tool relative to the machine.

20 Claims, 4 Drawing Sheets

PITCH ADJUSTMENT ASSEMBLY FOR MACHINE-MOUNTED TOOL

TECHNICAL FIELD

The present disclosure relates generally to a pitch adjustment assembly and, more particularly, to a pitch adjustment assembly for a machine-mounted tool.

BACKGROUND

Earth moving machines, for example dozers, motor graders, and wheel loaders, can have a front-mounted tool for pushing or carrying material. Some applications of these machines benefit from the tool being pitched forward or rearward about a horizontal axis that is generally perpendicular to a travel direction. Historically, the pitch angle of a machine tool was manually adjusted by way of a turnbuckle link that extended between a frame of the machine and an upper edge of the tool, in general alignment with the travel direction. In particular, shortening of the turnbuckle link generally resulted in rearward pitching of the tool, while lengthening of the turnbuckle link generally resulted in forward pitching of the tool.

While the turnbuckle link may have been suitable for some situations, it could also be problematic. For example, the turnbuckle link could self-adjust and/or rock back-and-forth when exposed to extreme vibrations, causing the pitch of the tool to move away from a desired angle. The turnbuckle link was also expensive and prone to damage under high loads. Further, because of the variable nature of the turnbuckle link, it may have been difficult to attain a consistent pitch angle of the tool between uses of the machine.

An alternative manual pitch adjustment assembly is disclosed in U.S. Pat. No. 5,853,051 of Buchanan et al. that issued on Dec. 29, 1998 (the '051 patent). Specifically, the '051 patent discloses a top link assembly for a construction machine that is used to adjust the pitch angle of a blade. The top link assembly includes a first adjustment plate connected to a top edge of the blade, and a second adjustment plate connected to a frame riser of the construction machine. Slots are formed within each of the adjustment plates. The top link assembly also includes spacer plates located at opposing sides of the adjustment plates that extend from the slots of the first adjustment plate to the slots of the second adjustment plate. Fasteners pass through holes in the spacer plates and the slots in the adjustment plates to engage corresponding nuts, such that tightening of the nuts causes the spacer plates to sandwich the adjustment plates therebetween and fix the pitch angle of the blade. With this configuration, loosening of the nuts and repositioning of the fasteners along a length of the slots results in a change of the pitch angle.

Although the top link assembly of the '051 patent may provide for a lower cost and/or reliable way to adjust the pitch angle of a work tool, it may still be less than optimal. In particular, the fasteners used to fix the pitch angle of the top link assembly may be exposed to high shear loads. In this configuration, the fasteners may need to be specially hardened to resist the shear loads without failure, which could be costly. In addition, it may be possible for the spacer plates to slide relative to the adjustment plates and thereby inadvertently adjust the pitch angle of the tool, if the fasteners are not properly tightened.

The pitch adjustment assembly of the present disclosure addresses one or more of the needs set forth above and/or other problems of the prior art.

SUMMARY

In one aspect, the present disclosure is directed to an assembly for adjusting a pitch of a tool relative to a machine. The assembly may include a link with a first end connectable to the tool and a second end connectable to the machine. The assembly may also include a bushing configured to engage a slot in at least one of the machine and the tool. An offset bore may be formed in the bushing. The assembly may also include a pin passing through the offset bore of the bushing and the link. The bushing may be reconfigurable between a plurality of discrete positions within the slot to incrementally adjust the pitch of the tool relative to the machine.

In another aspect, the present disclosure is directed to a kit for an assembly used to adjust a pitch of a tool relative to a machine. The kit may include a first set of bushings, each having an offset bore formed therein, and a first pin configured to pass through the first set of bushings. The kit may also include at least a second set of bushings, each having an offset bore formed therein, and a second pin configured to pass through the second set of bushings. The first and the at least a second set of bushings may provide for pitch adjustments of about 4-8°.

In another aspect, the present disclosure is directed to a machine. The machine may include a machine frame having slots formed therein at a front end, and a tool pivotally connected at a lower edge to the machine frame and having slots formed therein at an upper edge. The machine may also include a link having a first end and a second end, a first bearing disposed within the first end of the link, and a first set of bushings configured to engage the slots in the machine frame. Each bushing of the first set of bushings may be located at opposing ends of the first bearing and have an offset bore formed therein. The machine may further include a first pin passing through the first bearing and the offset bores of the first set of bushings, and a first retainer configured to retain the first set of bushings engaged with the machine frame and to engage the first pin. The machine may additionally include a second bearing disposed within the second end of the link, and a second set of bushings configured to engage the slots in the tool. Each bushing of the second set of bushings may be located at opposing ends of the second bearing and have an offset bore formed therein. The machine may also include a second pin passing through the offset bores of the second set of bushings and through the second bearing, and a second retainer configured to retain the second set of bushings engaged with the tool and to engage the second pin. At least one of the first and second sets of bushings is reconfigurable between a plurality of discrete positions within the slots to incrementally adjust the pitch of the tool relative to the machine.

DETAILED DESCRIPTION

Figure 1:
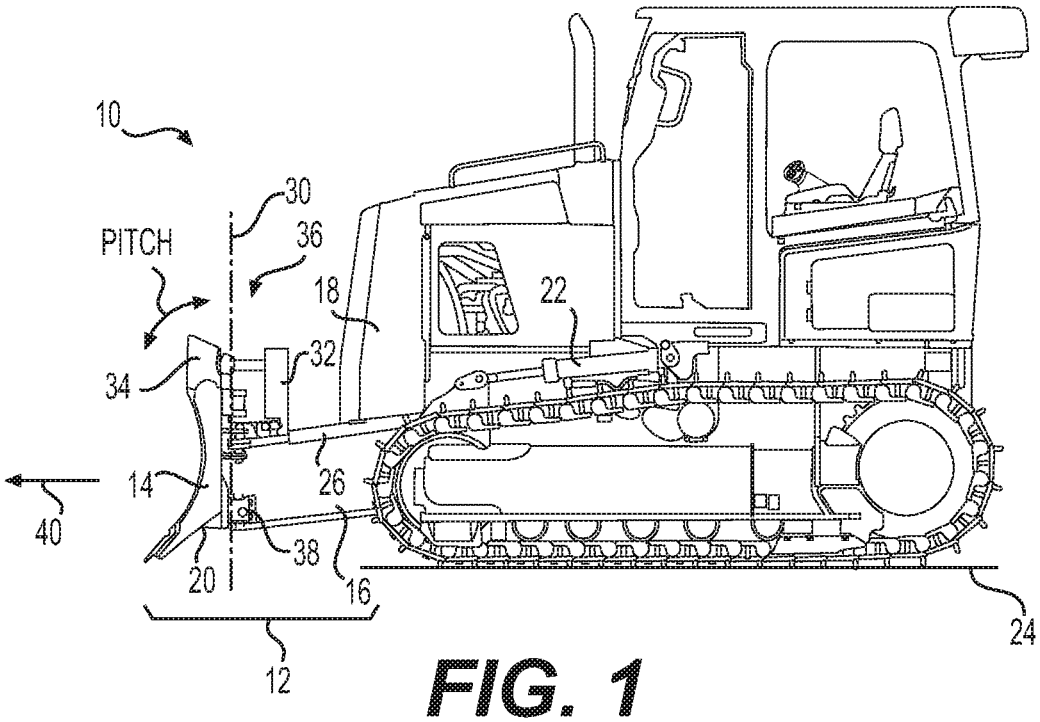
FIGS. 1 and 2 are side and top view pictorial illustrations of an exemplary disclosed machine, respectively.
Figure 2:
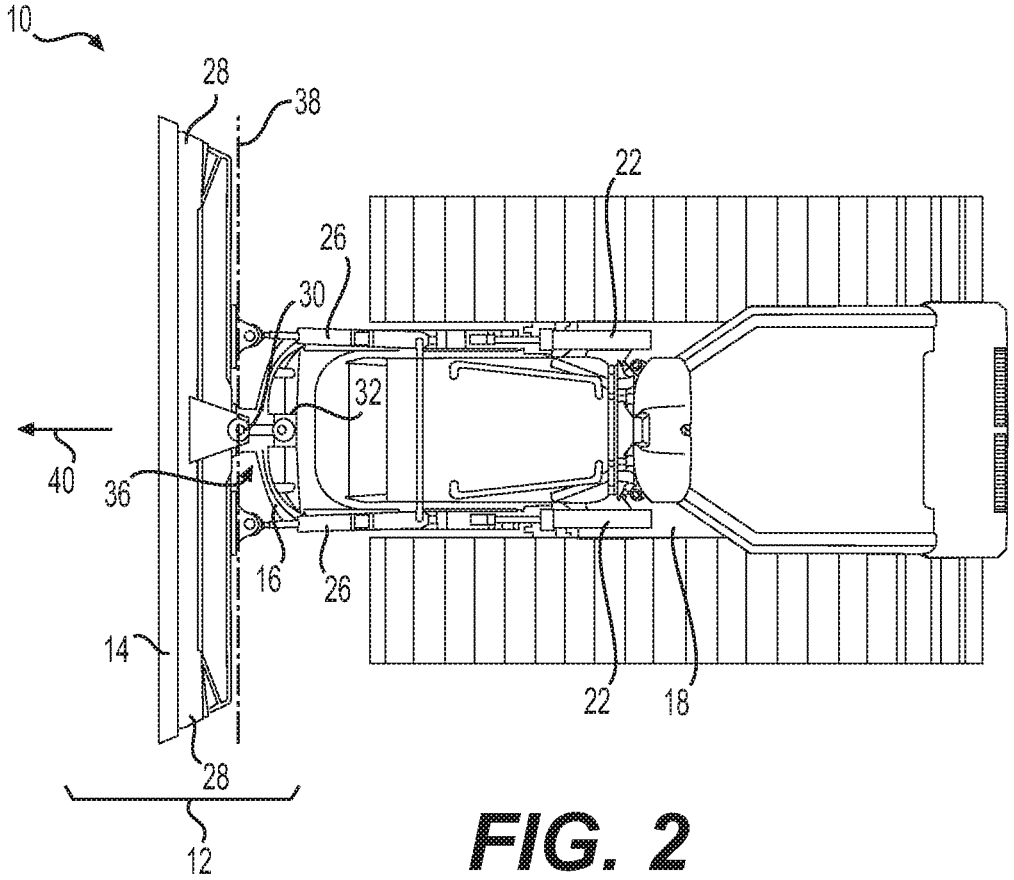

FIGS. 1 and 2 illustrate an exemplary machine 10 having multiple systems and components that cooperate to accomplish a task. Machine 10 may embody a mobile machine that performs some type of operation associated with an industry such as mining, construction, farming, transportation, or another industry known in the art. For example, machine 10 may be a material moving machine such as a dozer, a motor grader, a wheel loader, a snow plow, or similar machine. Machine 10 may include, among other things, an implement system 12 configured to move a work tool ("tool") 14.

Implement system 12 may include a linkage structure that is manually powered and/or acted on by fluid actuators to move work tool 14. In the disclosed example, implement system 12 includes a generally C-shaped machine frame 16 that is pivotally connected at opposing ends to a body 18 of machine 10 and at a center to a lower edge 20 (shown only in FIG. 1) of work tool 14. A pair of lift cylinders 22 may pivotally connect legs of frame 16 to body 18, and function to raise and lower work tool 14 relative to a ground surface 24. A pair of yaw cylinders 26 may pivotally connect the legs of frame 16 to opposing side edges 28 (shown only in FIG. 2) of work tool 14, and be functional to yaw work tool 14 about a vertical axis 30. A riser 32 may extend vertically upward away from the center of frame 16 toward an upper edge 34 of work tool 14, and a pitch adjustment assembly ("assembly") 36 may pivotally connect a distal tip of riser 32 to upper edge 34. Assembly 36 may be functional to pitch work tool 14 about a horizontal axis 38 that is generally perpendicular to axis 30 and to a travel direction 40 of machine 10. In some embodiments, an additional roll cylinder (not shown) may extend from the tip end of riser 32 to a point on work tool 14 located between riser 32 and side edge 28. The roll cylinder, if included, may function to roll work tool 14 about a horizontal axis that is generally aligned with the travel direction 40 of machine 10. It should be noted that other linkage structure configurations may also be possible.

Numerous different work tools 14 may be attachable to a single machine 10 and operator controllable. Work tool 14 may include any device used to perform a particular task such as, for example, a blade, a bucket, a plow, or another task-performing device known in the art. Although connected in the embodiment of FIG. 1 to pivot in the vertical and horizontal directions relative to frame 16 and body 18 of machine 10 and to lift relative to ground surface 24, work tool 14 could additionally slide, swing, open and close, or move in another manner known in the art.

Figure 3:
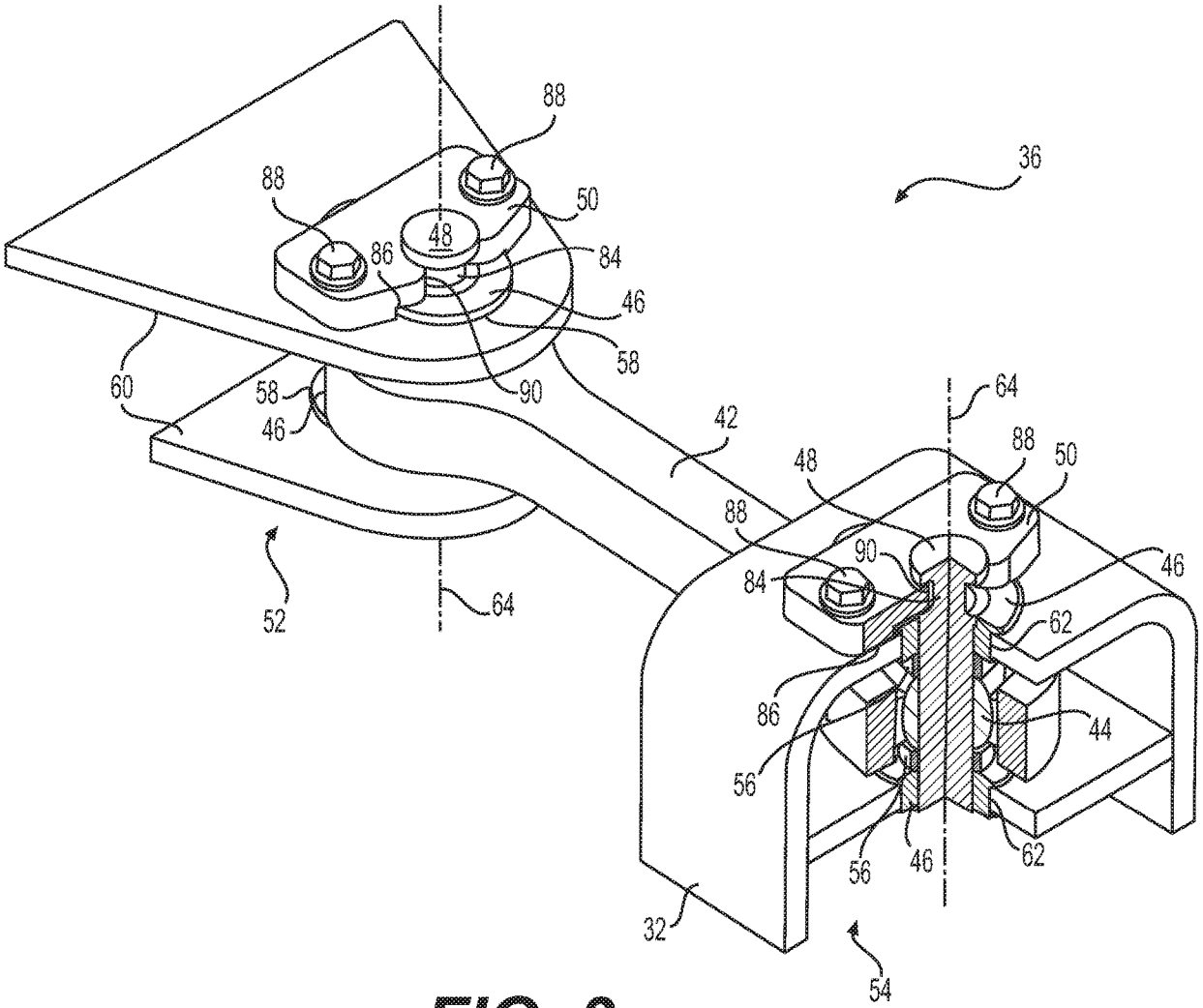
FIG. 3 is an isometric illustration of an exemplary disclosed pitch adjustment assembly that may be used in conjunction with the machine of FIGS. 1 and 2.

As shown in FIG. 3, assembly 36 may include different components that cooperate to allow manual pitch adjustment of tool 14 relative to machine 10 (e.g., relative to frame 16 and/or body 18). These components may include, among other things, a link 42, bearings 44, bushings 46, pins 48, and retainers 50. Link 42 may have a tool end 52 and a machine end 54. One bearing 44 may be disposed inside each of tool and machine ends 52, 54, and a set of bushings 46 may be located at each end of link 42 to sandwich the corresponding bearing 44 therebetween. In some embodiments, one or more spacers 56 may be located between the axial ends of each bearing 44 and the associated bushings 46. Bushings 46 may be configured to engage slots 58 in tool 14 (e.g., in a mounting bracket 60 that extends rearward from tool 14) and similar slots 62 in machine 10 (e.g., in riser 32 of frame 16). One pin 48 may pass through each set of bushings 46, the bearing 44 located therebetween, and the associated slots 58 or 62, to thereby pivotally connect the corresponding ends 52 or 54 of link 42 to tool 14 and machine 10. During operation, as tool 14 is shifted left/right, yawed, lifted, or otherwise translated or rotated, link 42 may function to maintain a desired pitch angle of tool 14 relative to frame 16.

Link 42 may be a conventional connecting link having a dog-bone shape. For example, ends 52 and 54 may be generally circular, have parallel axis 64, and be connected to each other by a slender rib section. Ends 52 and 54 may also be hollow, so as to receive bearings 44 therein, and have an internal curvature to generally match an external curvature of bearings 44. In some embodiments, one or both of ends 52, 54 may be provided with a grease port (not shown), if desired. In the embodiment shown in FIG. 3, axes 64 are oriented vertically when assembly 36 is assembled to machine 10. It is contemplated, however, that another orientation may alternatively be utilized.

Bearings 44 may be any type of bearings known in the art that allow pivoting of link 42 about axes 64 with reduced friction. In the disclosed embodiment, bearings 44 are a spherical bearings that permit some angular misalignment between link 42 (i.e., between axes 64) and pins 48 that may occur during operation of machine 10. Bearings 44 may be pressed into ends 52, 54 of link 42. In some embodiments, at least a portion (e.g., an inner race) of each bearing 44 may extend a distance past corresponding axial end faces of ends 52, 54.

Figure 4:
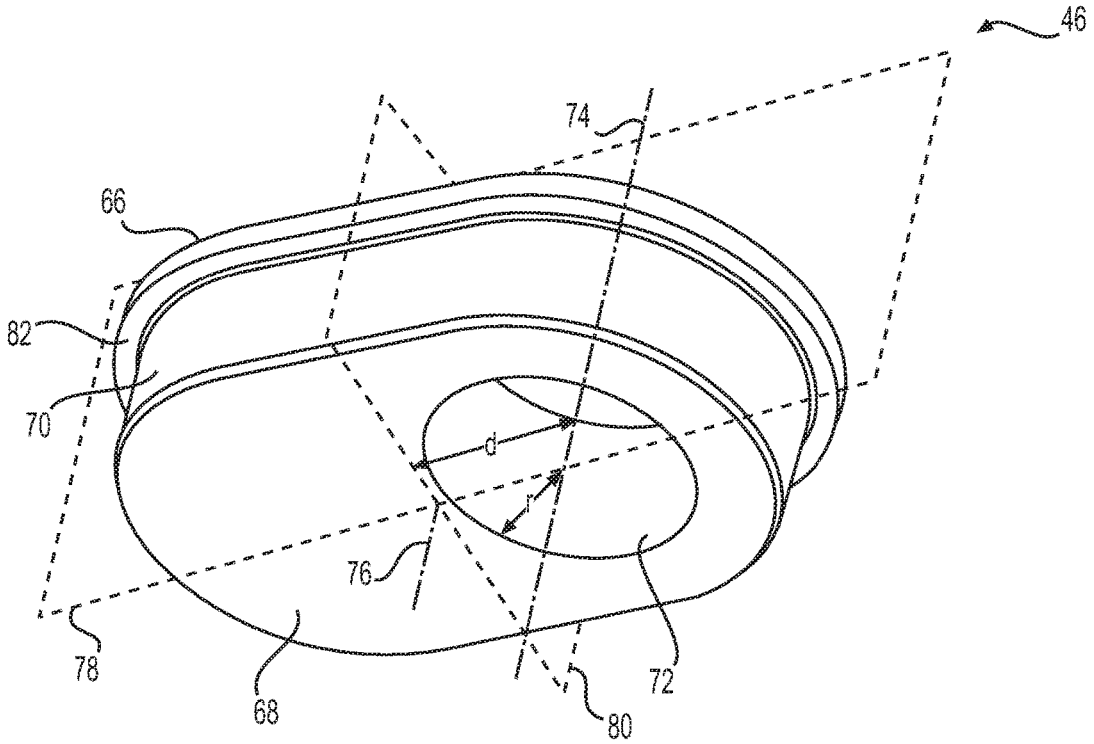
FIG. 4 is an isometric illustration of an exemplary bushing that may form a portion of the pitch adjustment assembly of FIG. 3.

An exemplary bushing 46 is shown in FIG. 4. As shown in this figure, bushing 46 includes an elongated body having a generally flat top 66, a generally flat and parallel bottom 68, and a continuous side surface 70 that extends between top 66 and bottom 68. In the disclosed embodiment, surface 70 consists of opposing straight portions interposed with shorter curved portions. For example, bushing 46 could have a generally elliptical shape, but with the portions lying along the major axis having little (if any) curvature.

Figure 5:
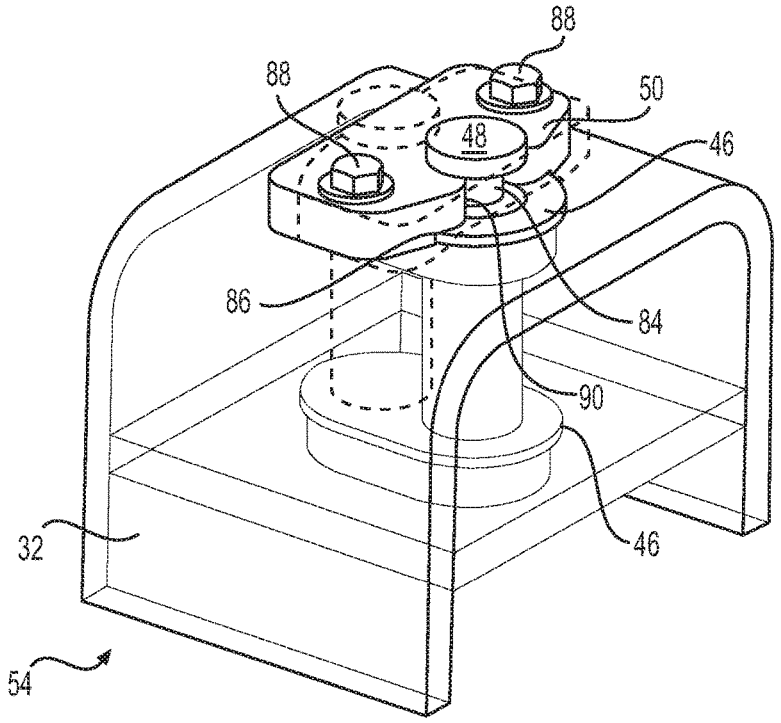
FIG. 5 is a partially transparent isometric illustration of an exemplary disclosed portion of the pitch adjustment assembly of FIG. 3.

An offset bore 72 may be formed within the body of bushing 46 to pass from top 66 through bottom 68, and have an axis 74. Axis 74 may be offset a distance d from a true center axis 76, and be defined by the orthogonal intersection of two planes 78, 80 passing symmetrically through the body of bushing 46. In one embodiment, the distance d may be less than a radius r of bore 72, such that if two bushings 46 were located within the same space but oriented 180° apart, as is shown in FIG. 5, the two bores 72 would overlap somewhat. As will be explained in more detail below, this may allow for fine control over pitch angle adjustments.

In some embodiments, a lip 82 (referring back to FIG. 4) may be formed at top 66 to extend radially outward a distance past a terminus of surface 70. Lip 82 may be partial and extend outward from any combination of the straight and curved portions of surface 70 or, as is shown in FIG. 4, completely encircle the body of bushing 46. Lip 82 may function to limit an insertion depth into slots 58, 62. In some embodiment, lip 82 may additionally be functional carry part of an axial load passing through pin 48, if desired. Specifically, lip 82 may be configured to rest on adjacent upper surfaces of tool 14 or machine 10 (i.e., of bracket 60 or riser 32), when the remainder of bushing 46 has been inserted into slot 58 or 62. Although any orientation may be possible, all bushings 46 in the disclosed embodiment are inserted into the corresponding slots from a top-down direction, such that bushing 46 is supported against the pull of gravity by the tool or machine surfaces.

Pin 48 (referring to FIG. 3) may function as a pivot for bearing 44 and as a means for connecting link 42 to machine 10 and tool 14. In particular, pin 48 may have a head, and a shank extending axially away from the head. The shank of pin 48 may pass through an upper bushing 46, be pressed through bearing 44 (e.g., into the inner race of bearing 44), and pass through a lower bushing 46. A groove 84 may be formed at a shank-side of the head and, as will be explained in more detail below, function as a guide for axially positioning pin 48.

Retainer 50 may function to retain bushing 46 inside the corresponding slot 58 or 60 during operation of machine 10, without exerting significant axial forces on bushing 46. Specifically, retainer 50 may have a center recess 86 shaped to provide clearance around top 66, and outer edges that extend past top 66 to engage the adjacent machine or tool surfaces. One or more fasteners 88 may pass through corresponding bores (not shown) in retainer 50 to threadingly connect with machine 10 or tool 14 at locations outward of the perimeter of bushing 46. As fasteners 88 are tightened, retainer 50 may be pressed down against the machine or tool surfaces, such that recess 86 substantially encloses (e.g., encloses on three sides) bushing 46. This connection, because of the clearance provided by recess 86, does not exert axial force on bushing 46. As such, some relative transverse motion between may occur between bushing 46 and retainer 50. The allowance of transverse motion may permit fasteners 88 to carry only axial loads, allowing for reduced shear strength of fasteners 88.

Retainer 50 may also function to position pin 48. In particular, a notch 90 may be formed near a lengthwise center of retainer 50, at one side of retainer 50. Notch 90 may be shaped and sized to fit into groove 84, thereby limiting axial motion of pin 48. When retainer 50 is fixed to the adjacent machine or tool surface, the engagement of notch 90 with groove 84 also fixes the axial position of pin 48.

Spacer 56 may be disposed between each bushing 46 and a corresponding axial end of the associated bearing 44. In the disclosed embodiment, spacer 56 is generally ring-like and has an axial thickness sufficient to take up clearance between bearing 44 and bushing 46. It is contemplated that spacer 56 may be omitted or included at only one side of bearing 44, if desired.

Slots 58 and 62 may be elongated slots having a general shape and size conforming to the shape and size of bushing 46 at surface 70. Specifically, pairs of spaced apart and aligned slots 58 and 62 may be fabricated within tool 14 and machine 10, respectively, to slidingly receive paired sets of bushings 46, while inhibiting rotation of bushings 46 and pass through of lips 82. Slots 58 and 62 may be symmetrical along two intersecting planes that generally align with planes 78 and 80 of bushing 46, such that bushing 46 may fit into slots 58 and 62 in two different and opposing directions. For the purposes of this disclosure, the act of placing bushings 46 into slots 58 or 62 in the different directions may be considered reconfiguring of bushings 46. It should be noted that slots 58 in tool 14 may be generally aligned with slots 62 in machine 10 (e.g., the planes lying along the major axis of slots 58 and 62 may be aligned) and aligned with travel direction 40.

FIGS. 6-9 represent different possible ways to reconfigure bushings 46, and the resulting pitch angles. FIGS. 6-9 will be discussed in more detail in the following section to further illustrate the disclosed concepts.

INDUSTRIAL APPLICABILITY

The disclosed pitch adjustment assembly may be used with any machine having a work tool that is capable of pitching relative to a body of the machine. The disclosed pitch adjustment assembly may be particularly useful when applied to a dozer having a blade that is hydraulic movable in additional directions. Operation of the pitch adjustment assembly, in connection with FIGS. 6-9, will now be described in detail.

Figure 7:
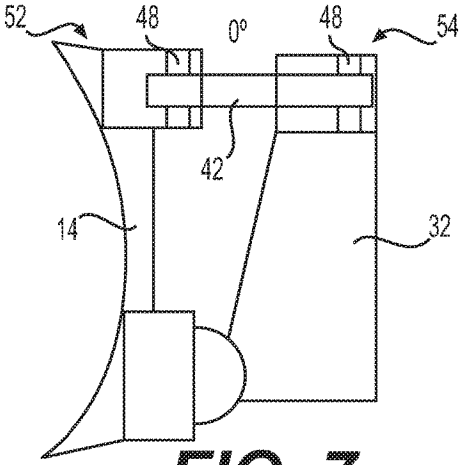
FIGS. 6-9 are diagrammatic illustrations of exemplary operating positions of the pitch adjustment assembly of FIG. 3.
Figure 9:
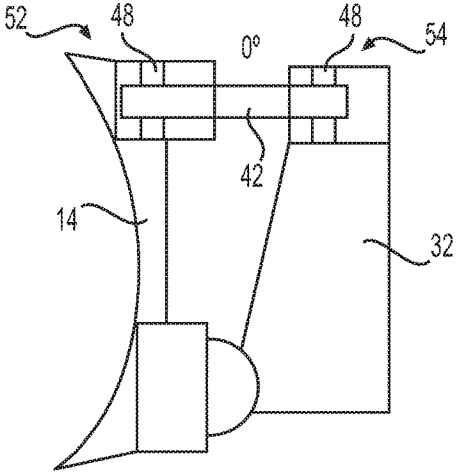
Figure 6:
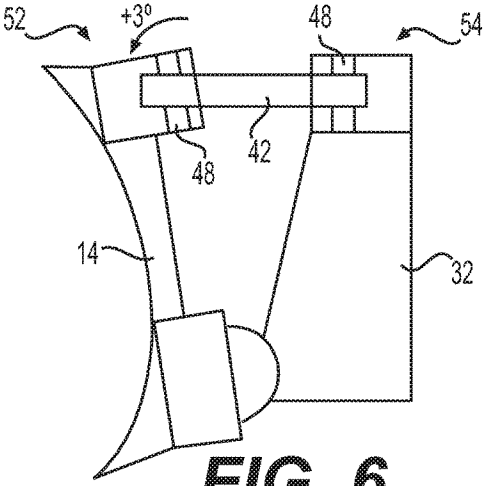
Figure 8:
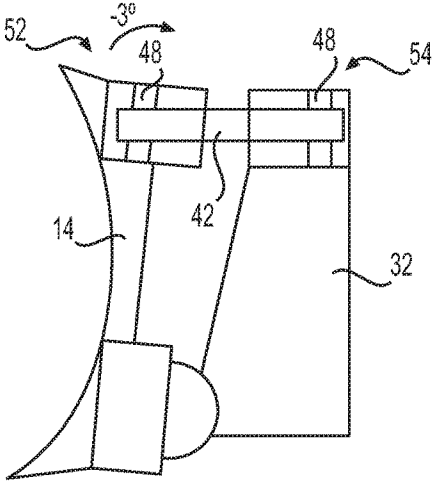

As shown in FIGS. 6-9, assembly 36 may be selectively reconfigured to produce at least three different pitch angles of tool 14 relative to machine 10 within a range of about 4-8° (e.g., about 6°). FIG. 6 illustrates a pitch forward position, at which upper edge 34 is pitched forward by a greatest amount (e.g., about 3° forward from a neutral position). FIG. 7 illustrates a first neutral position, at which tool 14 is considered to be oriented substantially vertical. FIG. 9 illustrates a second neutral position. FIG. 8 illustrates a pitch rearward position, at which upper edge 34 is pitched rearward by a greatest amount (e.g., about 3° rearward from a neutral position).

Each of the different pitch positions may be achieved by selectively orienting bushings 46 in one of two discrete positions or orientations. For the purposes of this disclosure, the first position may be a position at which offset bore 72 (referring to FIG. 4) is located in front of center axis 76, relative to the travel direction 40 (referring to FIG. 1). The second position may be a position at which offset bore 72 is locate behind center axis 76, relative to travel direction 40. The neutral, pitch forward, and pitch rearward positions of FIGS. 6-9 can be obtained either by orienting both sets of bushings 46 (i.e., the set of bushings 46 associated with tool end 52 and the set of bushings 46 associated with machine end 54) in the first position, by orienting both sets of bushings 46 in the second position, or by orienting one set of bushings 46 in the first position and one set of bushings 46 in the second position.

For example, to achieve the pitch forward position of FIG. 6, the set of bushings 46 at tool end 52 must be reconfigured to be in the second position, while the second set of bushings at machine end 54 must be reconfigured to be in the first position. To reconfigure a particular end (i.e., either tool end 52 or machine end 54) of assembly 36, a technician must first remove the associated fasteners 88 from retainer 50, pull pin 48 out of bushings 46 and bearing 44, and pivot link 42 to the side. Thereafter, spacers 56 may be moved out of the way, and bushings 46 lifted out of the corresponding slots 58 or 60. Bushings 46 may then be reoriented by about 180° along a horizontal plane, and then reinstalled. Spacers 56 may be put back in place, and link 42 pivoted back into alignment with bushings 46. In some instances, it may be necessary to tilt tool 14 to achieve this new alignment. Thereafter, pin 48 may be pushed back through bushings 46 and bearing 44, retainer 50 may be placed back onto the tool or machine surface, and fasteners 88 may be reinstalled. When this occurs, upper edge 34 may be moved furthest away from riser 32.

To achieve the neutral positions of FIG. 7 or 9, both sets of bushings 46 must be reconfigured to be in either the first position (FIG. 9) or in the second position (FIG. 7). In either of these configurations, upper edge 34 may be at about the same distance away from riser 32.

To achieve the pitch rearward position of FIG. 8, the set of bushings 46 at tool end 52 must be reconfigured to be in the first position, while the second set of bushings at machine end 54 must be reconfigured to be in the second position. When this occurs, upper edge 34 may be moved closest to riser 32.

It should be noted that, when a particular set of bushings 46 is moved from the first position to the second position, or vice versa, retainer 50 must also be reoriented in order to engage groove 90 of pin 48. That is, as bushings 46 switch orientations, the location of pin 48 moves relative to the associated tool or machine surface on which retainer 50 is fastened. This is shown in FIG. 5. Thus, in order for notch 90 of retainer 50 to move with pin 48 and remain in groove 90, retainer 50 must be flipped around (e.g., turned by 180° relative to the threaded bores in the tool or machine surface) to face in the opposite direction.

In the disclosed embodiment, all bushings 46 shown in the example of FIGS. 3 and 4 are identical. That is, all of the bushings 46 have the same offset distance d. However, it is contemplated that bushings 46 may have different offset distances d, if desired. For example, the set of bushings 46 associated with tool end 52 could have a first offset distance $d_1$, while the set of bushings 46 associated with machine end 54 could have a second offset distance $d_2$. By utilizing sets of bushings 46 having different offset distances d, more than three distinct pitch positions may be achieved.

In some applications, an adjustment kit may be provided having multiple sets of bushings 46 and associated pins. In some embodiments, each set of bushings 46 in the adjustment kit may have different offset distances d. This adjustment kit may additionally include instructions, explaining the different pitch positions that could be achieved and the corresponding combination of bushing 46 required for each position.

The disclosed pitch adjustment assembly may have improved durability, cost, and stability. In particular, because the fasteners used to secure assembly 36 at a particular pitch angle may be exposed to only axial loading (i.e., minimal shear loading), the fasteners may have an extended life. In addition, it may be possible to utilize lower-cost fasteners due to the reduced loading experienced by the fasteners. Further, because the bushings used to set the pitch angle may fit precisely (i.e., with little clearance) into conforming slots, there may be little (if any) opportunity for the bushings to slide within the slots away from desired pitch angle positions. This may help to improve the stability of machine 10.

It will be apparent to those skilled in the art that various modifications and variations can be made to the pitch adjustment assembly of the present disclosure without departing from the scope of the disclosure. Other embodiments will be apparent to those skilled in the art from consideration of the specification and practice of the pitch adjustment assembly disclosed herein. It is intended that the specification and examples be considered as exemplary only, with a true scope of the disclosure being indicated by the following claims and their equivalent.

What is claimed is:

1. An assembly for adjusting a pitch of a tool relative to a machine, the assembly comprising:

a link having a first end connectable to the tool and a second end connectable to the machine;

a bushing configured to engage a slot in at least one of the machine and the tool, the bushing having an offset bore formed therein;

a pin passing through the offset bore of the bushing and the link; and a retainer configured to retain the bushing engaged with the at least one of the machine and the tool;

wherein the retainer has an internal recess configured to provide clearance for the bushing; and wherein the bushing is reconfigurable between a plurality of discrete positions within the slot to incrementally adjust the pitch of the tool relative to the machine.

2. The assembly of claim 1, wherein the offset bore is positioned on an axis a distance, d, away from a true center of the bushing, wherein d is less than a radius of the offset bore.

3. The assembly of claim 1, wherein:

the pin has a groove formed at an end thereof; and the retainer is further configured to engage the groove and thereby axially position the pin.

4. The assembly of claim 3, wherein the retainer is reversibly connectable to the at least one of the machine and the tool to engage the pin as the bushing is reconfigured to the plurality of discrete positions.

5. The assembly of claim 1, further including a spacer disposed between the link and the bushing.

6. The assembly of claim 1, further including at least one fastener configured to connect the retainer to the at least one of the machine and the tool, wherein the at least one fastener is only axially loaded by the bushing engaging the retainer.

7. The assembly of claim 1, wherein:

the slot is a first slot;

the bushing is a first bushing configured to engage the first slot;

the assembly includes a second bushing substantially identical to the first bushing and configured to engage a second slot in general alignment with the first slot; and the pin passes through the offset bores of both of the first and second bushings.

8. The assembly of claim 7, wherein:

the pin is a first pin; and the assembly further includes:

a first bearing disposed within the first end of the link between the first and second bushings and configured to receive the first pin;

a second bearing disposed within the second end of the link;

third and fourth bushings configured to engage slots at first and second sides of the second bearing; and a second pin substantially identical to the first pin and passing through offset bores of the third and fourth bushings and through the second bearing.

9. The assembly of claim 8, wherein the third and fourth bushings are substantially identical to the first and second bushings.

10. The assembly of claim 9, wherein a distance between axial locations of the offset bore of each of the first, second, third, and fourth bushings, when reconfigured between opposing discrete positions, is less than a diameter of the first and second pins.

11. The assembly of claim 8, wherein the third and fourth bushings have an offset distance from a center of the offset bore to a center of the third and fourth bushing that is different from an offset distance of the first and second bushings.

12. The assembly of claim 8, wherein reconfiguration of the first, second, third, and fourth bushings between the plurality of discrete positions produces at least three pitch adjustments of the tool relative to the machine.

13. The assembly of claim 1, wherein the bushing includes a lip configured to perform at least one of insertion depth limiting into the slot and axial load bearing.

14. The assembly of claim 13, wherein the lip completely encircles the bushing.

15. A kit for an assembly used to adjust a pitch of a tool relative to a machine, the kit comprising:

a first set of bushings, each bushing of the first set of bushings including a first offset bore formed therein, wherein the first set of bushings includes a first bushing;

a first pin configured to pass through the first set of bushings;

at least a second set of bushings, each bushing of the second set of bushings including a second offset bore formed therein;

a second pin configured to pass through the second set of bushings, wherein the first set of bushings and the at least a second sets of bushings provide for pitch adjustments of about 4-8°; and a retainer having a recess formed therein, wherein the recess is configured to receive at least part of the first bushing therein, and wherein the retainer is configured to retain the first bushing in a slot of one of the tool or the machine.

16. The kit of claim 15, wherein:

the first set of bushings have a first offset distance between a first bore center and a first bushing center; and the second set of bushings have a second offset distance between a second bore center and a second bushing center that is different from the first offset distance.

17. A machine, comprising:

a machine frame having slots formed therein at a front end;

a tool pivotally connected at a lower edge to the machine frame and having slots formed therein at an upper edge;

a link having a first end and a second end;

a first bearing disposed within the first end of the link;

a first set of bushings configured to engage the slots in the machine frame, each bushing of the first set of bushings located at opposing ends of the first bearing and having a first offset bore formed therein;

a first pin passing through the first bearing and the first offset bores of the first set of bushings;

a first retainer configured to retain the first set of bushings engaged with the machine frame and to engage the first pin;

a second bearing disposed within the second end of the link;

a second set of bushings configured to engage the slots in the tool, each bushing of the second set of bushings located at opposing ends of the second bearing and having a second offset bore formed therein;

a second pin passing through the second offset bores of the second set of bushings and through the second bearing; and a second retainer configured to retain the second set of bushings engaged with the tool and to engage the second pin;

wherein at least one of the first and second sets of bushings is reconfigurable between a plurality of discrete positions within the slots to incrementally adjust the pitch of the tool relative to the machine;

wherein each of the first and second retainers has an internal recess configured to provide bushing clearance.

18. The machine of claim 17, wherein:

the machine further includes at least one fastener configured to connect each of the first and second retainers to the corresponding one of the machine and the tool, wherein the at least one fastener is only axially loaded during operation.

19. The machine of claim 18, wherein reconfiguration of the at least one of the first and second sets of bushings between the plurality of discrete positions produces at least three pitch adjustments of the tool relative to the machine.

20. The assembly of claim 18, wherein the bushings are elliptical in shape.

* * * * *